US011617454B2

(12) United States Patent
Aston et al.

(10) Patent No.: US 11,617,454 B2
(45) Date of Patent: Apr. 4, 2023

(54) FIXTURE FOR STORAGE AND PRESENTATION OF GOODS

(71) Applicant: Shopco U.S.A., Inc., Houston, TX (US)

(72) Inventors: Dwight Stuart Aston, Houston, TX (US); Tommy Joseph Morris, Sr., Houston, TX (US)

(73) Assignee: Shopco U.S.A., Inc., Houston, TX (US)

( * ) Notice: Subject to any disclaimer, the term of this patent is extended or adjusted under 35 U.S.C. 154(b) by 102 days.

(21) Appl. No.: 16/938,354

(22) Filed: Jul. 24, 2020

(65) Prior Publication Data

US 2022/0022666 A1 Jan. 27, 2022

(51) Int. Cl.

| | |
|---|---|
| ***A47F 5/00*** | (2006.01) |
| ***A47F 1/12*** | (2006.01) |
| ***A47F 5/01*** | (2006.01) |
| ***A47F 5/13*** | (2006.01) |
| ***A47F 3/06*** | (2006.01) |
| ***A47F 3/14*** | (2006.01) |

(52) U.S. Cl.

CPC ..... *A47F 5/0025* (2013.01); *A47F 1/126* (2013.01); *A47F 3/063* (2013.01); *A47F 3/14* (2013.01); *A47F 5/005* (2013.01); *A47F 5/0068* (2013.01); *A47F 5/01* (2013.01); *A47F 5/13* (2013.01)

(58) Field of Classification Search

CPC .. A47F 5/0025; A47F 5/01; A47F 5/13; A47F 5/005; A47F 5/0068; A47F 1/126; A47F 1/125

See application file for complete search history.

(56) References Cited

U.S. PATENT DOCUMENTS

| | | | | |
|---|---|---|---|---|
| 3,308,961 | A * | 3/1967 | Chesley | A47F 1/121 211/59.3 |
| 4,890,746 | A * | 1/1990 | Trulaske, Sr. | A47F 5/01 211/153 |
| 6,082,557 | A * | 7/2000 | Leahy | A47B 96/021 211/59.3 |
| 6,866,156 | B2 * | 3/2005 | Nagel | A47F 1/126 211/59.3 |
| 7,703,614 | B2 * | 4/2010 | Schneider | A47F 1/126 211/59.3 |
| 7,784,626 | B2 * | 8/2010 | Jacques | A47B 96/1416 211/103 |
| 9,986,854 | B2 * | 6/2018 | Riley | A47F 1/126 |
| 10,123,637 | B1 * | 11/2018 | DeSena | A47F 5/0068 |

(Continued)

FOREIGN PATENT DOCUMENTS

| | | | | |
|---|---|---|---|---|
| EP | 1514493 | A1 * | 3/2005 | A47B 57/585 |
| EP | 2974626 | A1 * | 1/2016 | A47F 5/005 |

(Continued)

*Primary Examiner* — Kimberley S Wright

(57) ABSTRACT

A fixture for storage and presentation of goods includes a support structure and a multitude of rod shelves disposed on the support structure. Each of the multitude of rod shelves includes support brackets and rods disposed between the support brackets. The fixture further includes a multitude of configurable trays disposed on the multitude of rod shelves and configured to hold the goods. Each of the multitude of configurable trays is removably clipped to the rods of one of the multitude of rod shelves to occupy substantially all available space between the support brackets.

14 Claims, 12 Drawing Sheets

(56) References Cited

U.S. PATENT DOCUMENTS

2007/0090068 A1* 4/2007 Hardy ..... A47F 1/126 211/59.3
2007/0138114 A1* 6/2007 Dumontet ..... A47F 1/126 211/59.3
2010/0116760 A1* 5/2010 Fazzone ..... G09F 23/00 211/49.1
2010/0307998 A1* 12/2010 Chen ..... A47B 96/021 211/184
2011/0147323 A1* 6/2011 Sainato ..... A47F 1/12 40/642.02
2013/0206713 A1* 8/2013 Hardy ..... A47F 5/0093 211/49.1
2014/0055987 A1* 2/2014 Lindblom ..... A47F 11/10 362/125
2014/0138330 A1* 5/2014 Hardy ..... A47F 7/0007 211/59.3
2015/0164241 A1* 6/2015 Nagel ..... A47F 1/125 211/59.3
2015/0289683 A1* 10/2015 Walker ..... A47B 57/583 211/186
2017/0127853 A1* 5/2017 Colelli ..... A47F 5/0025
2018/0110345 A1* 4/2018 Sun ..... A47F 1/12
2018/0184814 A1* 7/2018 Nagel ..... A47F 1/126
2018/0263380 A1* 9/2018 Riley ..... A47F 5/005
2020/0187675 A1* 6/2020 Obitts ..... A47B 96/061
2020/0214472 A1* 7/2020 Nagel ..... A47F 1/126
2020/0281370 A1* 9/2020 Nagel ..... A47F 5/16
2021/0330094 A1* 10/2021 Smedley ..... A47B 57/42

FOREIGN PATENT DOCUMENTS

EP 3915438 A1 * 12/2021 ..... A47B 96/021
WO WO-2005025386 A1 * 3/2005 ..... A47B 57/585
WO WO-2007073294 A1 * 6/2007 ..... A47B 96/02
WO WO-2009151381 A1 * 12/2009 ..... A47B 57/586

* cited by examiner

FIXTURE FOR STORAGE AND PRESENTATION OF GOODS

BACKGROUND

Fixtures for the storage and presentation of goods include counters, shelves, cabinets, racks, etc. The type of fixture to be used may depend on various factors, including but not limited to the type of environment (e.g., a convenience store, grocery store, supermarket), the user (store employees, manufacturer representatives), the product (size, form factor, weight, value). Frequently, it is desirable to present a maximum of goods (volume and/or variety) using a limited amount of available space in an organized, visually appealing manner. For these and other reasons, a fixture capable of accommodating a large volume of goods of the same or different types may be desirable. Further, a fixture that is easily operable, e.g., when picking and restocking goods, and reconfigurable, e.g., to change the types of good being accommodated, may be desirable.

SUMMARY

In general, in one aspect, one or more embodiments relate to a fixture for storage and presentation of goods, the fixture comprising: a support structure; a plurality of rod shelves disposed on the support structure, wherein each of the plurality of rod shelves comprises: support brackets; and rods disposed between the support brackets; a plurality of configurable trays disposed on the plurality of rod shelves and configured to hold the goods, wherein each of the plurality of configurable trays is removably clipped to the rods of one of the plurality of rod shelves to occupy substantially all available space between the support brackets.

In general, in one aspect, one or more embodiments relate to a configurable tray assembly to be disposed in a fixture for storage and presentation of goods, the configurable tray assembly comprising: a tray base plate with a bottom surface configured to be disposed onto a rod shelf of the fixture; a plurality of pusher assemblies disposed on a top surface of the tray base plate, wherein each of the plurality of pusher assemblies is configured to hold goods between a stationary front plate of the pusher assembly, and a movable pusher plate configured to push the goods toward the front plate.

In general, in one aspect, one or more embodiments relate to a method for operating a fixture for storage and presentation of goods, the method comprising: loading a configurable tray assembly with goods by: arresting a pusher plate of a pusher assembly on the configurable tray assembly in a locked configuration that maximizes product space between the pusher plate and a front plate, loading goods in the product space of the pusher assembly, and releasing the arrested pusher plate based on receiving a backward pushing force provided by the goods.

Other aspects of the disclosed disclosure will be apparent from the following description and the appended claims.

DETAILED DESCRIPTION

Figure 1:
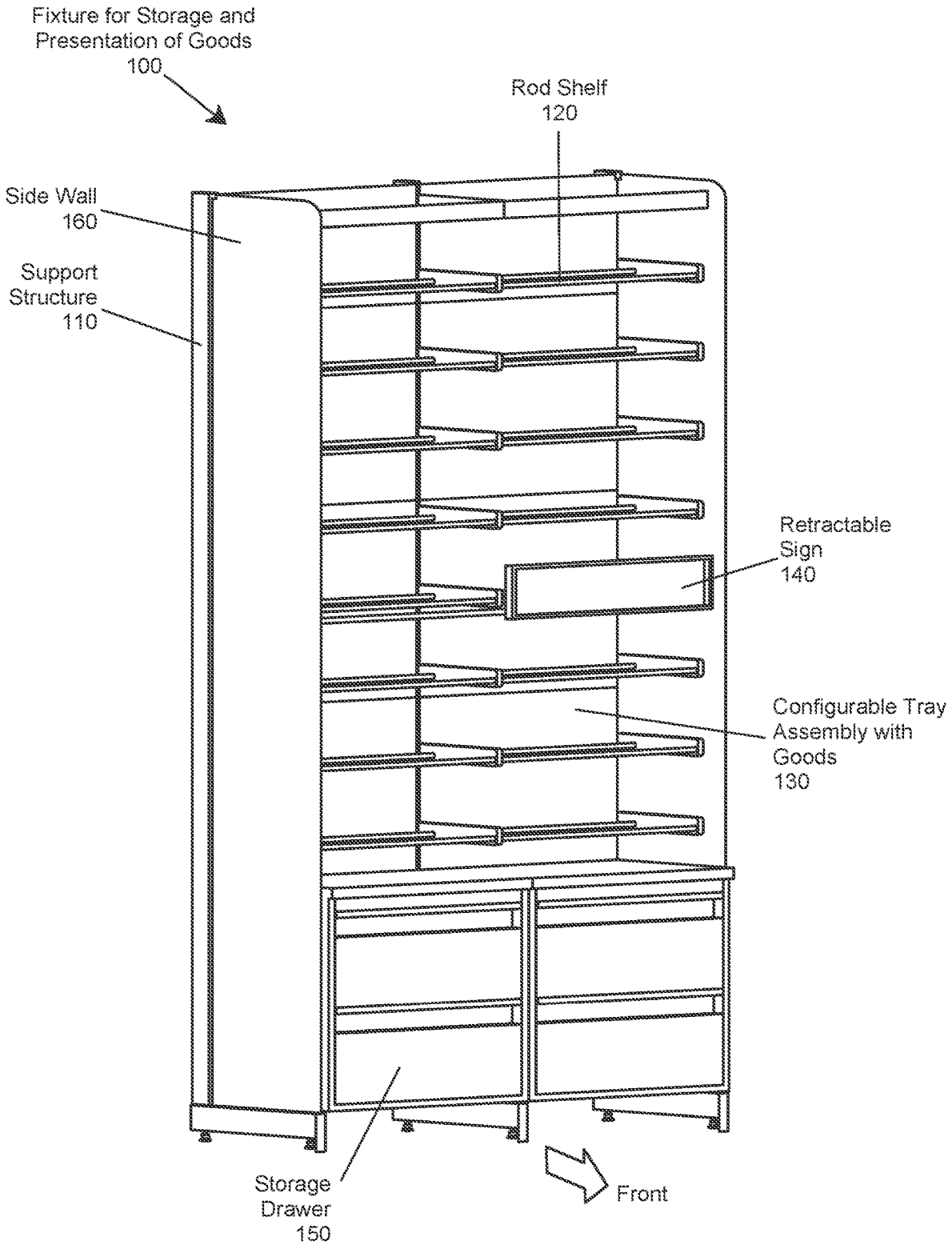
FIG. 1 shows a fixture for storage and presentation of goods, in accordance with one or more embodiments of the disclosure.

Specific embodiments of the disclosed technology will now be described in detail with reference to the accompanying figures. Like elements in the various figures may be denoted by like reference numerals and/or like names for consistency.

The following detailed description is merely exemplary in nature, and is not intended to limit the disclosed technology or the application and uses of the disclosed technology. Furthermore, there is no intention to be bound by any expressed or implied theory presented in the preceding technical field, background, brief summary or the following detailed description.

In the following detailed description of embodiments of the disclosed technology, numerous specific details are set forth in order to provide a more thorough understanding of the disclosed technology. However, it will be apparent to one of ordinary skill in the art that the disclosed technology may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Various embodiments of the disclosure relate to a fixture for the storage and presentation of goods. The subsequently described fixture may be suitable for the storage and presentation of smaller goods. For example, the fixture may be used to sell tobacco products and/or other products of comparable size, e.g., in a convenience store, grocery store, or supermarket. The fixture may be used to store and present such goods in a space-efficient, easy-to-operate, yet visually appealing manner, while also allowing a reconfiguration as needed to support different goods. As described below, the fixture may also support signage without adversely affecting storage capacity and without interfering with the picking and/or restocking of goods. As such, the fixture, in accordance with one or more embodiments, may be an effective tool for marketing and selling goods in convenience stores, grocery stores, supermarkets, etc.

Turning to FIG. 1, a fixture (100) for storage and presentation of goods, in accordance with one or more embodiments, is shown. The fixture (100) includes a support structure (110), multiple rod shelves (120), multiple configurable trays (130), one or more retractable signs (140), and one or more storage drawers (150). Each of these components is subsequently described.

The support structure (110) may consist of metal tubing configured to support other components of the fixture, as further discussed with reference to FIG. 2. Powder-coated steel tubing may be used for the support structure. Other materials, e.g. alloys, may be used without departing from the disclosure. The support structure (110) may include leg sections for floor support. In FIG. 1, the support structure (110) includes three leg sections with adjustable legs to accommodate uneven floors. Vertical or substantially vertical sections to provide support for the other components of the fixture (100) may extend from the leg section, forming the back of the fixture. Back panels (e.g. metal back panels), crossbars, or other structurally reinforcing elements may connect the vertical sections to provide additional stability. Different elements of the support structure (110) may be interconnected by welding, or using screws, bolts, etc. While FIG. 1 shows a particular geometry, other geometries may exist, without departing from the disclosure. For example, the support structure of FIG. 1 includes three leg sections with three vertical sections. Instead, a narrower support structure may include two leg sections with two vertical sections, or a wider support structure may include more than three leg section supporting more than three vertical sections. The support structure as shown in FIG. 1 may be, for example, 48 inches wide, 16 inches deep, and 84 inches high, or may have any other dimensions.

The fixture (100) may include multiple rod shelves (120). In the example of FIG. 1, the fixture includes two columns of eight rod shelves, with one of the rod shelves being covered by the retractable sign (140). A detailed description of a rod shelf (120) is provided below with reference to FIG. 2. Each of the rod shelves (120) may support a configurable tray assembly (130) for holding goods. To accommodate good of different heights, the vertical spacing of the rod shelves may be varied, as described with reference to FIG. 2. Further, a configurable tray assembly (130) is described below with reference to FIG. 3.

The fixture (100) may also include one or more retractable signs (140). In the example of FIG. 1, the fixture includes one retractable sign. The retractable sign may be used for marketing and/or advertising purposes. For better visibility, the retractable sign may be illuminated. The sign may be retractable to provide access to the space behind the retractable sign (140). A rod shelf (120) with a configurable tray assembly (130) holding goods may be behind the retractable sign (140). To facilitate access, the retractable sign may be designed such that it may be retracted and may remain in the retracted position for as long as desired, e.g., when loading the fixture (100) with goods. Retractable signs (140) and mechanisms enabling the retraction are described below with reference to FIG. 6A, FIG. 6B, FIG. 6C, and FIG. 6D.

The fixture (100) may further include one or more storage drawers (150). In the example of FIG. 1, the fixture includes four storage drawers. Storage drawers may be disposed in the bottom area of the fixture (100), where goods may be less visible. While the fixture (100) in FIG. 1 is equipped with four storage drawers, in alternative embodiments, a fixture (100) may be equipped with only two side-by-side storage drawers (150). These storage drawers may be deeper, thus supporting larger and/or more items. Alternatively, a fixture (100) may also be equipped with a storage cabinet instead of or in addition to the storage drawers. The storage cabinet may be equipped with a hinged cabinet door. The fixture may accommodate any number of storage drawers and/or storage cabinets of any size at any location within the fixture. Storage cabinets and storage drawers may be made of sheet metal, e.g., powder-coated sheet metal, or any other material. The storage cabinets and storage drawers may be supported by the support structure, as described for the rod shelf with reference to FIG. 2.

The fixture (100) may also include side walls (160). A side wall may be provided on one side of the fixture, on both sides, or not at all. A side wall may be made of sheet metal, e.g., powder-coated sheet metal, or any other material. A side wall may be supported by the support structure, for example, by hooking into slotted support rails of the support structure, as described for the rod shelf with reference to FIG. 2.

Figure 2:
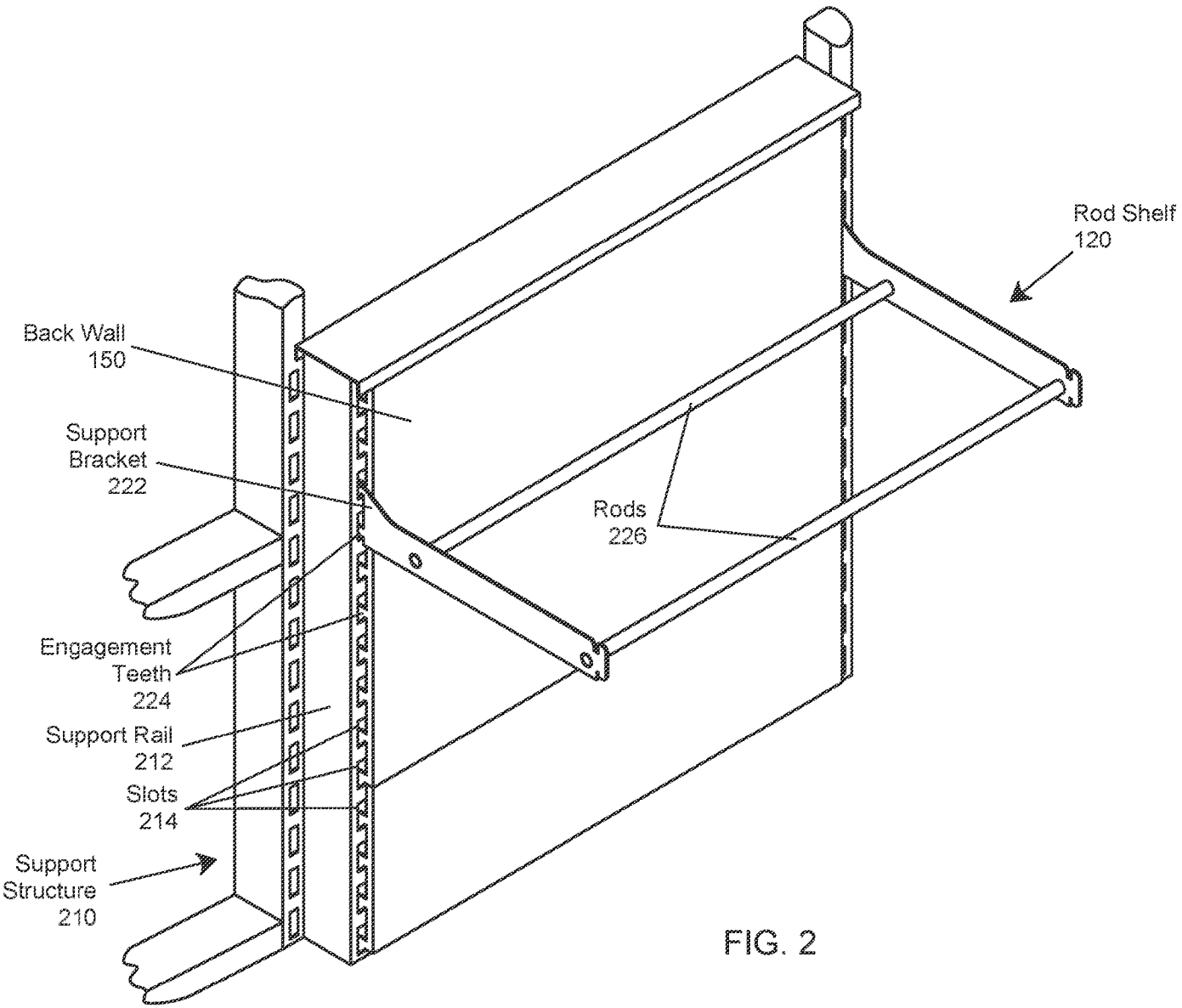
FIG. 2 shows a rod shelf on a support structure, in accordance with one or more embodiments of the disclosure.

Turning to FIG. 2, a rod shelf disposed on a support structure, in accordance with one or more embodiments, is shown. The support structure (210) may correspond to the support structure (110) in FIG. 1. Support rails (212) may be disposed on the vertical sections of the support structure or may be part of the vertical sections of the support structure. The support rails (212) may be equipped with openings, e.g. slots (214), allowing engagement of engagement teeth (224) of components to be supported by the support rail. In FIG. 2, a rod shelf (120), and a back wall (150) are supported by the support rails (212). The support rail may be equipped with series of equally or unequally spaced slots (214) allowing the placement of components at the desired heights. For example, multiple rod shelves (120) may be installed at different levels, as shown in FIG. 1 to provide vertical adjustability. The spacing of the rod shelves (by selecting slots of appropriate height), may be based on space requirements of the goods supported by the rod shelves, as further discussed below.

A rod shelf (120) may include two support brackets (222) and two or more rods (226) between the support brackets (222). The support brackets (222) may be made of steel or an alloy, and the rods (226) may be welded or otherwise attached to the support brackets (222). The support brackets (222) may include engagement teeth (224) for engagement with the slots (214) in the support rails (212). The support brackets (222) and the rods (226) may be powder coated or otherwise surface treated. The rod shelf (120) may support a configurable tray assembly (130), as further described below.

Figure 3:
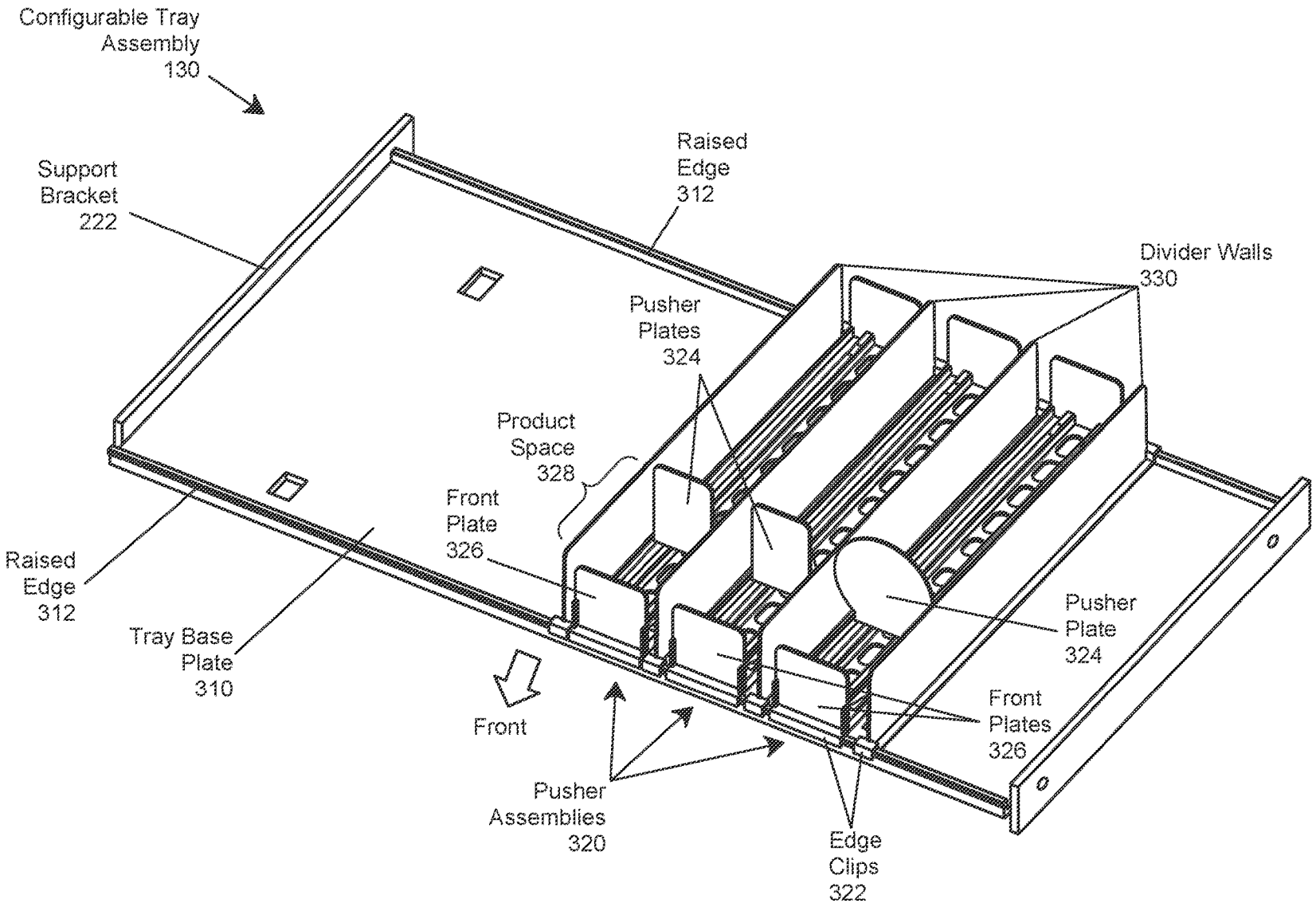
FIG. 3 shows a configurable tray assembly, in accordance with one or more embodiments of the disclosure.

Turning to FIG. 3, a configurable tray assembly, in accordance with one or more embodiments, is shown. The configurable tray assembly (130) may include a tray base plate (310), at least one pusher assembly (320), and divider walls (330). While the configurable tray (130), as shown in FIG. 3, is disposed on a rod shelf, only the support brackets (222) of the rod shelf are visible. The tray base plate (130) may be a plastic tray manufactured by, for example, injection molding. The tray base plate (310) may be substantially flat. The bottom surface of the tray base plate (310) may include ribs for stability, and may include other elements described below with reference to FIG. 4A. The width of the tray base plate (310) may be selected such that it spans substantially the entire area available between the support brackets (222), to maximize space available for product, in the configurable tray assembly (130). In one or more embodiments, the tray base plate (310) includes raised edges (312) on the front and back sides of the tray base plate. The raised edges (312) may allow edge clips (322) of pusher assemblies (320) and/or divider walls (330) to engage to hold the pusher assemblies (320). The raised edges may be equipped with a wider lip to improve the mechanical connection between the edge clips and the raised edges, when engaged. With the raised edges (312) forming continuous tracks along the front and back sides of the configurable tray (130), a pusher assembly, once attached to the tray base plate (310) by clipping of the edge clips into the raised edges, may still be laterally moved along the raised edges for optimal placement and readjustment, e.g., when pusher assemblies are added, removed, and/or shifted.

In FIG. 3, three pusher assemblies (320) of different configurations are shown disposed on the top surface of the tray base plate (310). The configurations are different to accommodate goods of different physical format. Each of the pusher assemblies may be used to hold goods of the same or similar physical format stacked in a column, as further discussed below with reference to FIG. 5A. In each of the pusher assemblies (320), a pusher plate (324) may apply a front-directed force to push goods in the product space (328) toward the stationary front plate (326). A detailed description is provided below with reference to FIGS. 5A, 5B, and 5C.

The product space may be laterally delimited by divider walls (330). Goods within the product space (328) may, thus, be laterally guided by the divider walls. A divider wall may be made of plastic, steel or an alloy, and may be equipped with edge clips (322) to attach to the raised edges (312) of the tray base plate (310). Divider walls (330) may be designed to minimize spatial requirements, e.g., divider walls may be made of a thin material (e.g. plastic), thus maximizing the available space for pusher assemblies (320) in the configurable tray assembly (130).

In one or more embodiments, any number of pusher assemblies (320) may be accommodated by the configurable tray assembly (130). The number of actual pusher assemblies (320) disposed on the tray base plate (310) may depend on various factors such as the types of goods to be loaded into the pusher assemblies. Generally speaking, fewer pusher assemblies (320) may be installed on the tray base plate (310) for larger (wider) goods and more pusher assemblies (320) may be installed on the tray base plate (310) for smaller (narrower) goods.

Figure 4A:
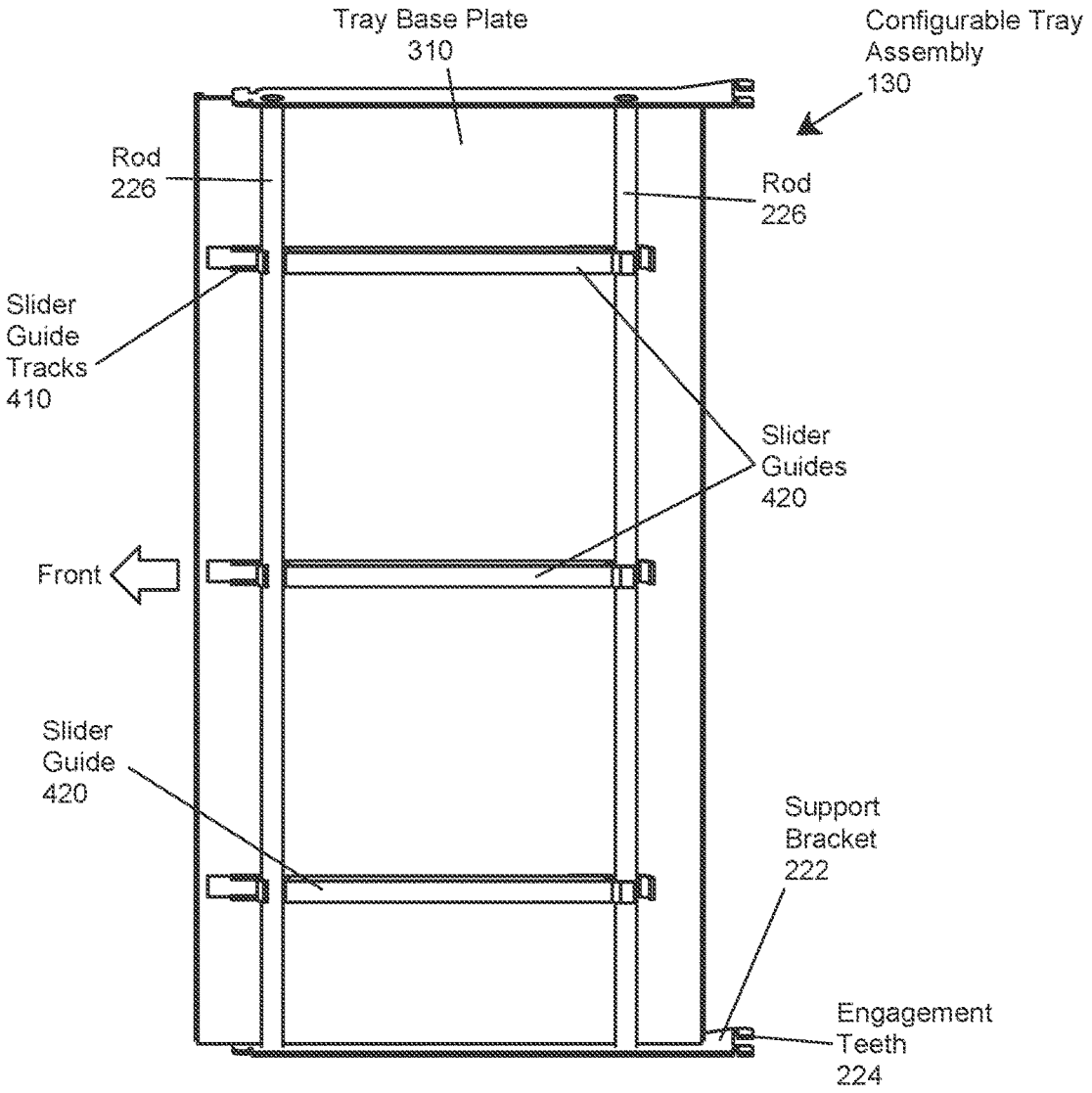
FIG. 4A shows a configurable tray assembly, in accordance with one or more embodiments of the disclosure.

Turning to FIG. 4A, a bottom view of a configurable tray assembly (130), in accordance with one or more embodiments, is provided. In the bottom view, a tray base plate (130) is disposed on the rods (226) between the support brackets (222) of a rod shelf. The engagement teeth (224) of the support brackets (222) can also be seen. In one or more embodiments, slider guides (420) provide a mechanical interface to removably clip the tray base plate (130) to the rods (226) of the rod shelf. In the example of FIG. 4A, three slider guides (420) are used. Any other number of slider guides (420) may be used without departing from the disclosure. The slider guides (420) may be part of the configurable tray assembly (130) and may be mechanically affixed to the tray base plate (130) using slider guide clips (410) or tracks, as illustrated in FIG. 4A. Once a slider guide (420) is disposed on the tray base plate (130), it may be held stationary by the slider guide clips (410). A slider guide (420) may, however be able to slide in a forward/backward direction, relative to the tray base plate (310). The slider guides (420) may thus allow the configurable tray assembly (130) to slide relative to the rod shelf (120) similar to a drawer. When the configurable tray assembly (130) is in a retracted position, it may be easier for a user to load pusher assemblies with goods. The installation of the configurable tray assembly with the slider guides (420) on the rod shelf (120) is described below with reference to FIG. 4B.

Figure 4B:
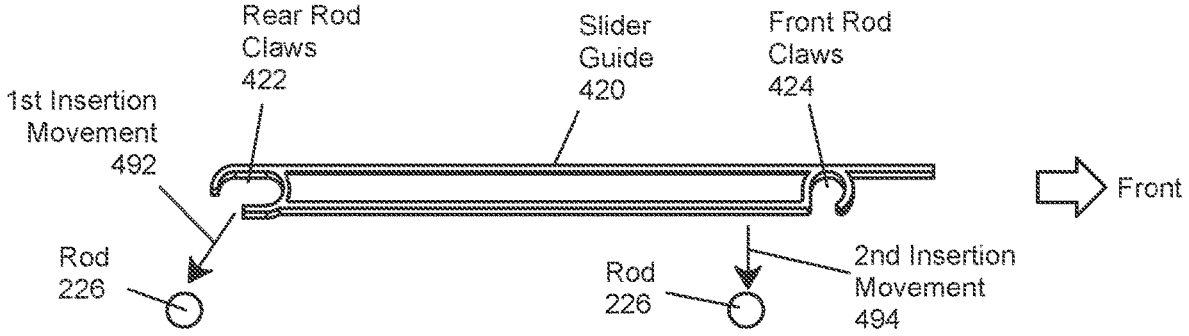
FIG. 4B shows a slider guide, in accordance with one or more embodiments of the disclosure.

FIG. 4B shows a slider guide, in accordance with one or more embodiments of the disclosure. Slider guides (420) may be used to mechanically attach the configurable tray assembly (130) to the rod shelf (120). Specifically, a slider guide (420), affixed to the tray base plate (130), may be equipped with claws configured to engage with the rods (226) of the rod shelf (120). In FIG. 4B, the slider guide (420) is made of a plastic material and includes rear rod claws (422) and a front rod claws (424) configured to engage with a rod (226) at the rear of the rod shelf (120) and a rod (226) at the front of the rod shelf (120), respectively, upon insertion of the configurable tray assembly into the rod shelf (120). The insertion may involve a two-step process including a first insertion movement (492), and a second insertion movement (494). The rear rod claws (492) are downward-oriented, e.g., at an angle of 45°. Accordingly, the first insertion movement (492) may involve a backward-downward movement of the configurable tray assembly (130) with the slider guides (130). As the rear rod claws come in contact with the rod (226), the rear rod claws (422) may slightly bend open to receive the rod (226). Once the rod is fully inserted into the rear rod claws (422), the rear rod claws may close, thus grasping the rod. The front rod claws (492) are downward-oriented, e.g., straight downward-oriented. After completion of the first insertion movement (492), the front rod claws (424) are substantially aligned with the rod at the front of the rod shelf (120) to allow a straight downward movement to have the front rod claw (424) engage with the rod. The second insertion movement (494) may, thus, involve a downward movement of the configurable tray assembly (130) with the slider guides (130). As the front rod claws come in contact with the rod (226), the front rod claws (422) may slightly bend open to receive the rod (226). Once the rod is fully inserted into the front rod claws (422), the front rod claws may close, thus grasping the rod. After completion of the first and second insertion movements (492, 494), and assuming that three slider guides (420) are part of the configurable tray assembly (130), as shown in FIG. 4A, six claws (three rear rod claws, three front rod claws) firmly, yet removably, connect the configurable tray assembly (130) to the rod shelf (120). To prevent a lateral sliding of the configurable tray assembly (130) on the rods (226), the support brackets (222) laterally delimit the space available for the tray base plate (310) of the configurable tray assembly (130).

Figure 5B:
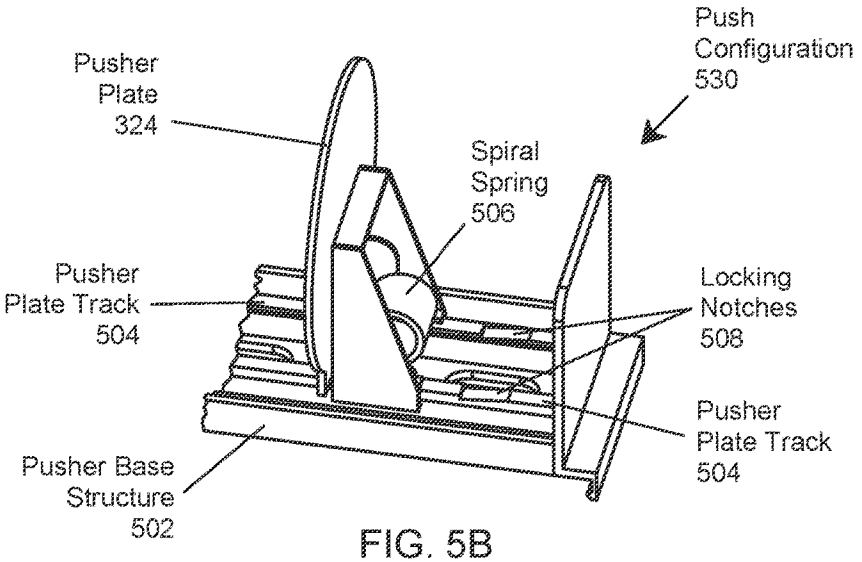
FIG. 5B shows a push configuration of a pusher assembly, in accordance with one or more embodiments of the disclosure.
Figure 5C:
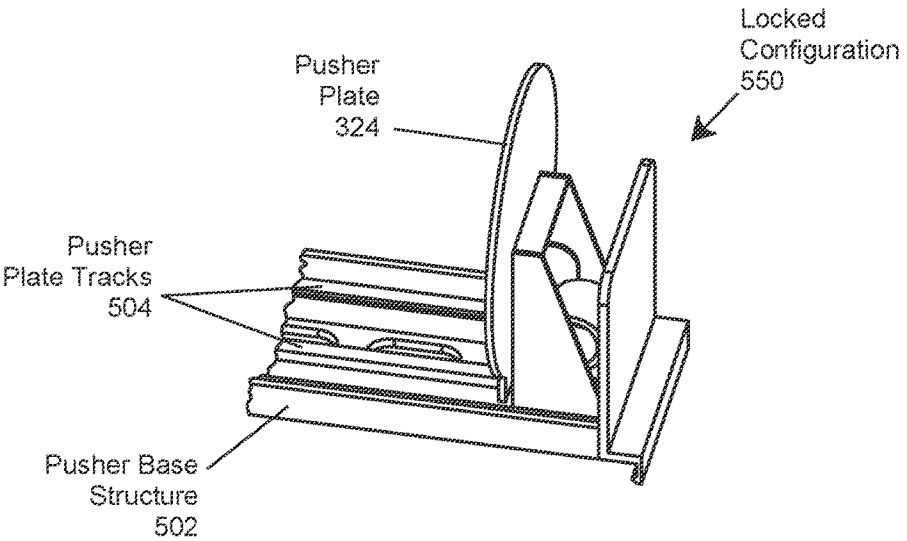
FIG. 5C shows a locked configuration of a pusher assembly, in accordance with one or more embodiments of the disclosure.
Figure 5A:
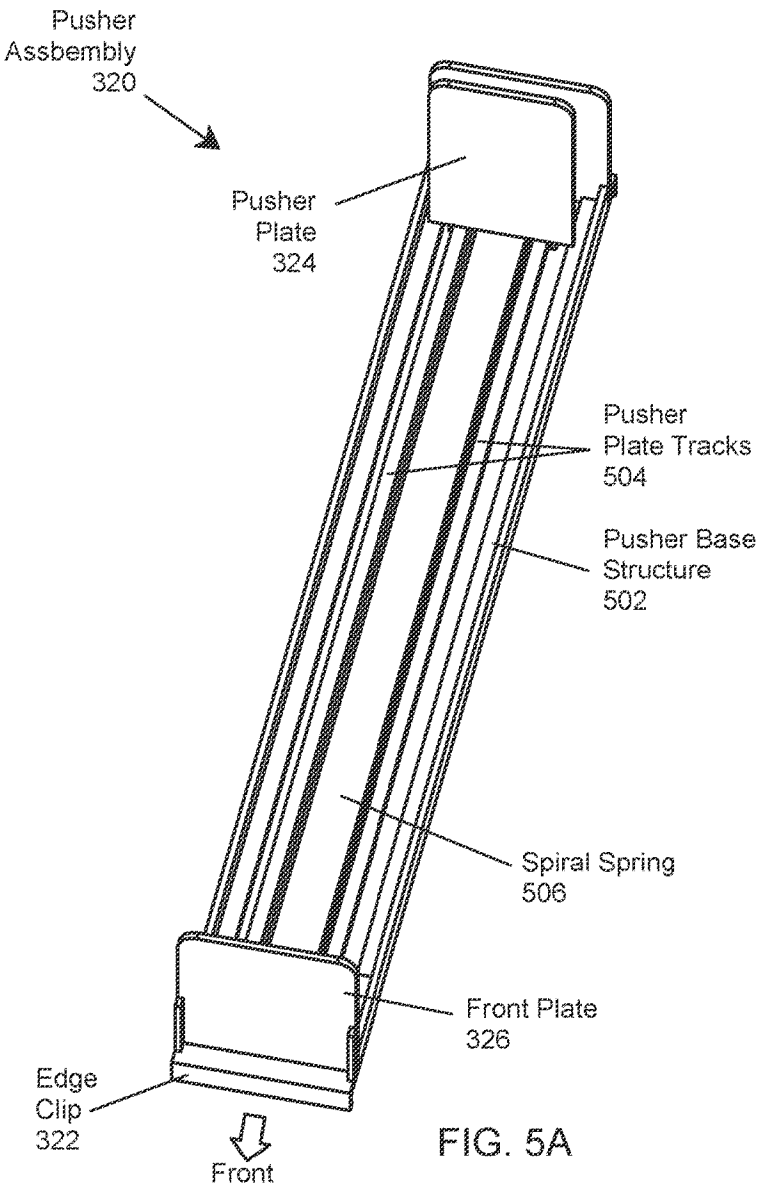
FIG. 5A shows a pusher assembly, in accordance with one or more embodiments of the disclosure.

Turning to FIG. 5A, a pusher assembly, in accordance with one or more embodiments of the disclosure, is shown. The pusher assembly (320) includes a pusher base structure (502), pusher plate tracks (504), a pusher plate (324), a spiral spring (506), a front plate (326), and edge clips (322). Pusher assemblies may be provided in various different sizes to accommodate differently shaped goods. For example, in a fixture used for storage and presentation of tobacco products, there may be pusher assemblies specific to tobacco products, including but not limited to cigarettes, snuff tobacco, cigars, vaping products, cannabidiol (CBD) products, etc. The pusher assembly may hold goods (not shown) in a column, between the pusher plate (324) and the front plate (326). The pusher plate (324) may apply a front-directed force to push the column of goods forward, toward the front plate (326), as goods are removed from the pusher assembly, e.g., when the goods are purchased by a customer.

The pusher base structure (502) may be a plate substantially spanning a distance between front and rear raised edges (312) of the tray base plate (310), when disposed on the tray base plate (310). The pusher base structure (502) may include edge clips (322) at a rear and a front end of the pusher base structure (502) to engage with the corresponding raised edges (312) when disposed on the tray base plate (310). The pusher base structure (502) may include the front plate (326), against which goods may be pushed by the pusher plate (324). The pusher base structure (502) may be made of a transparent material for better visibility of the goods through the front plate (326). For example, the pusher structure may be made of an injection-molded transparent plastic material. The pusher base structure (502), in one or more embodiments, includes pusher plate tracks (504) to guide the pusher plate (324). In the example shown in FIG. 5A, the pusher base structure (502) includes two parallel pusher plate tracks (504), but any number of pusher plate tracks may be used, without departing from the disclosure. The pusher plate tracks may extend to enable movement of the pusher plate from a rear position of the pusher plate (324) (as shown in FIG. 5A), which allows for fully loading the pusher assembly (320) with product, to a front position of the pusher plate (324) when no goods are left in the pusher assembly (320).

A spiral spring (506) is configured to generate a force applied by the pusher plate (324) in a direction toward the front plate (326). Accordingly, goods disposed between the pusher plate (324) and the front plate (326) may be continuously pushed forward to the front plate (326). As goods are removed, the pusher plate, thus, advances toward the front plate. The spiral spring, as shown in the example of FIG. 5A, forms a coil on a rear side of the pusher plate (324), as may be seen in FIG. 5B and FIG. 5C. The spiral spring may terminate in proximity of the front plate (326). As the pusher plate (324) is pushed backwards, e.g., when loading the pusher assembly (320) with goods, an uncoiled segment of the spiral spring extends between the front plate (326) and the pusher plate (324), as may be seen in FIG. 5A. While a flat spiral spring (506) is shown, other springs may be used without departing from the disclosure.

Turning to FIG. 5B, a push configuration (530) of a pusher assembly, in accordance with one or more embodiments of the disclosure, is shown. In the push configuration (530), the pusher plate (324) applies a force toward the front plate (see FIG. 5A), to push goods toward the front plate. The force is generated by the spiral spring (506). The pusher plate (324) may move freely on the pusher plate tracks (504) on the pusher base structure (502). In one or more embodiments, the pusher plate tracks include locking notches (508) as shown in FIG. 5B. The locking notches are intended to prevent the pusher plate (324) from moving toward the front plate. The locking notches (508) are disposed at a location near the rear end of the pusher plate tracks to arrest movement of the pusher plate (324) at a location maximally or near maximally toward the rear end of the pusher assembly. In this position of the pusher plate (324), the pusher assembly may be loaded with a maximum amount of goods without the pusher plate (324) pushing the goods in a forward direction, thus facilitating the loading of the pusher assembly with goods. In the push configuration (530) shown in FIG. 5B, the pusher plate (324) is not engaged with the locking notches (508). Accordingly, the pusher plate (324) may be pushing the goods toward the front plate (326), as shown in FIG. 5A. The push configuration (530) may, thus, be used under regular operating conditions, when goods may be retrieved from the pusher assembly (530), for example by a user removing the frontmost item (i.e., the item closes to the front plate (326). When this occurs, the pusher plate may push the goods in the pusher assembly (320) toward the front plate (320) to have the next item directly adjacent to the front plate (326).

Turning to FIG. 5C, a locked configuration (550) of a pusher assembly, in accordance with one or more embodiments of the disclosure, is shown. In the locked configuration (550), the pusher plate (324) is prevented from moving toward the front plate (see FIG. 5A), despite the spiral spring producing a force in the direction of the front plate. The pusher plate (324) is arrested by the locking notches (shown in FIG. 5B, not visible in FIG. 5C). As previously described with reference to FIG. 5B, the locked configuration (550) may be used to allow the loading of the pusher assembly with goods without the pusher plate (324) pushing the goods in a forward direction. A major advantage of the locked configuration is that a user may use both hands to load the pusher assembly with goods, because it is not necessary to use one hand to counter the force produced by the spring force during the loading.

To transition from the locked configuration (550) shown in FIG. 5C to the push configuration (530), a brief application of a manual force countering the force produced by the spiral spring (506) may be sufficient. Such a manual force may be applied by briefly pushing the goods in the pusher assembly toward the pusher plate (324), e.g., once the pusher assembly (320) is filled with goods. This may cause a slight pivoting of the pusher plate (324), thereby lifting the pusher plate out of the locking notches (508) to move freely on the pusher plate tracks (504).

Figure 5D:
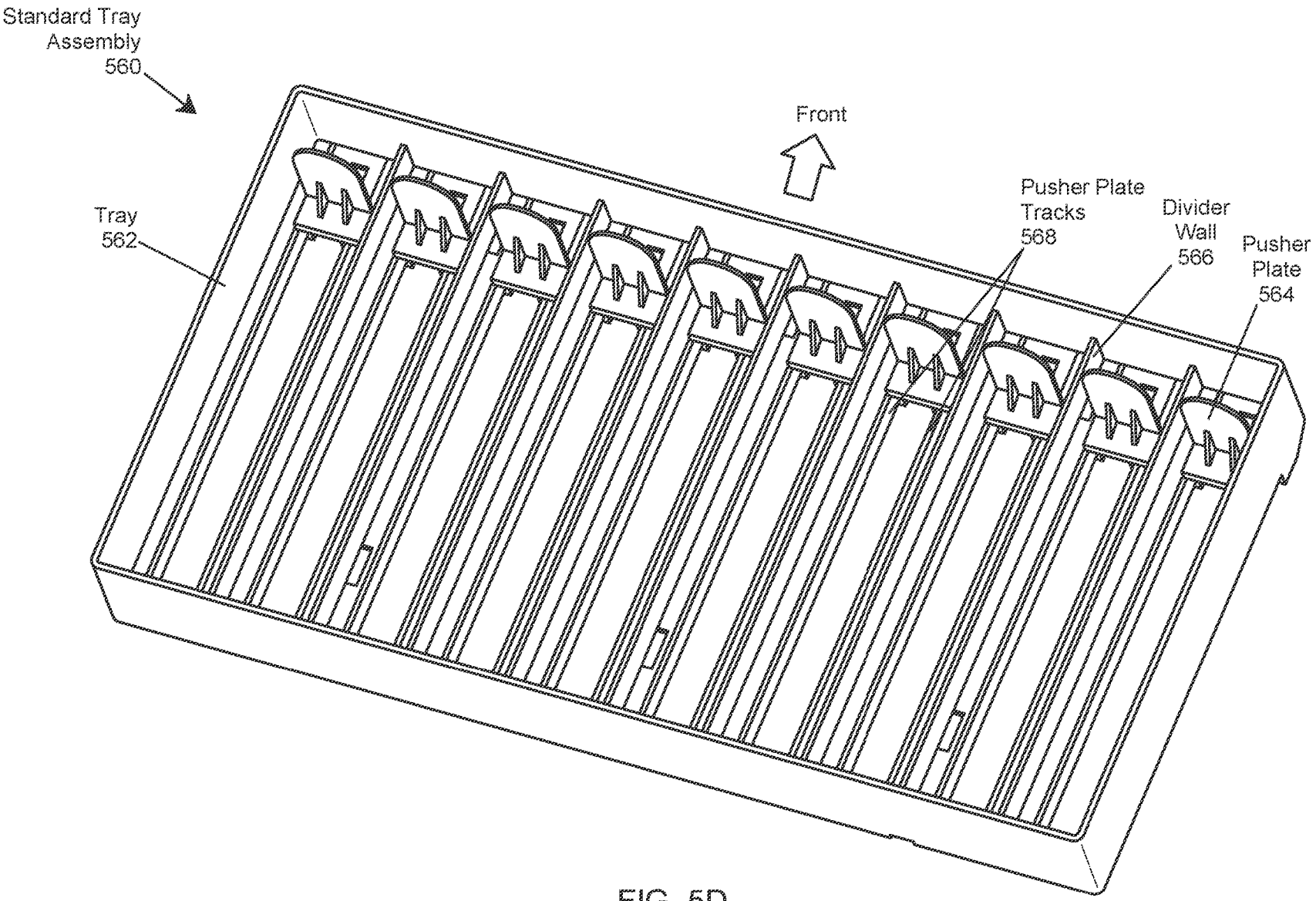
FIG. 5D shows a standard tray assembly, in accordance with one or more embodiments.

Turning to FIG. 5D, a standard tray assembly is shown, in accordance with one or more embodiments. The standard tray assembly (560) may be disposed on a rod shelf, similar to the configurable tray assembly of FIG. 3, using slider guides. However, unlike the configurable tray assembly, the standard tray assembly (560) is preconfigured for a particular physical format of the goods to be loaded into the tray assembly. For example, the standard tray assembly (560) may be preconfigured for standard cigarette packs. In the example of FIG. 5D, ten rows of standard cigarette packs (or other goods) may be loaded into the standard tray assembly (560), whereas common fixtures only support nine rows of standard cigarette packs. The additional tenth row is made possible by the subsequently discussed optimizations.

The tray (562) includes side walls that delimit the space available for the goods to be loaded into the tray. The tray (562) is optimized to use all available space on a rod shelf.

The tray (562) may further include divider walls (566). The side walls and the divider walls may be made of a thin material, e.g., a plastic material. Space is preserved in comparison to the manually installed divider walls of the configurable tray assembly of FIG. 3, such that a maximum of space in the standard tray assembly (560) is available for goods. Further, the tray (562) also includes pusher plate tracks (568) unlike in the configurable tray assembly of FIG. 3, where the pusher plate tracks are part of the modular pusher assembly. Pusher plates (564) may move on the pusher plate tracks (568) as previously described with reference to FIG. 3.

Figure 6A:
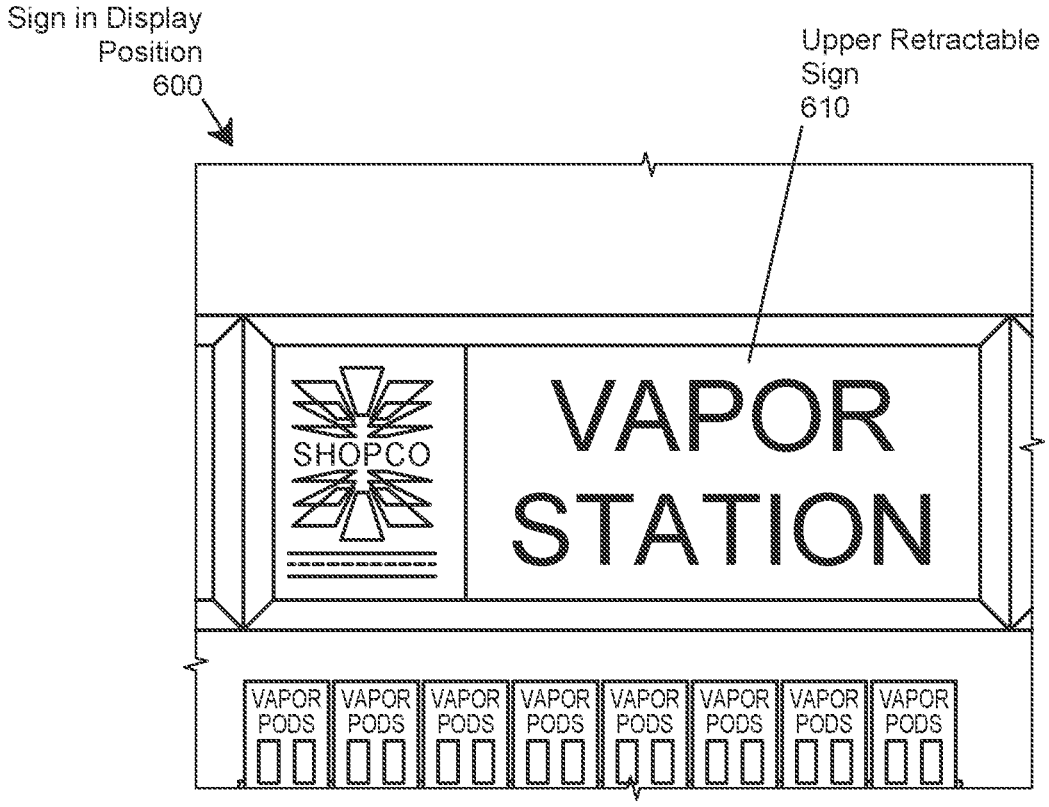
FIG. 6A shows an upper retractable sign in a display position, in accordance with one or more embodiments of the disclosure.
Figure 6B:
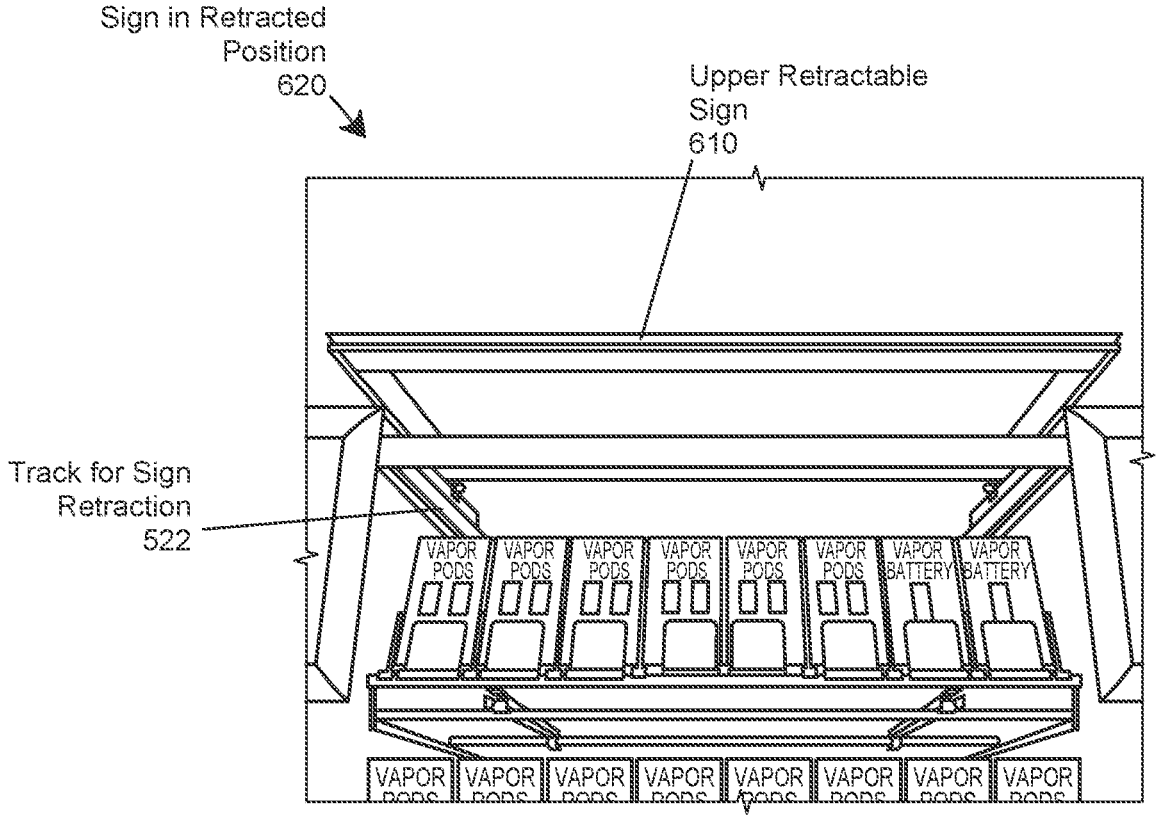
FIG. 6B shows an upper retractable sign in a retracted position, in accordance with one or more embodiments of the disclosure.

Turning to FIG. 6A and FIG. 6B, upper retractable signs, in accordance with one or more embodiments, are shown. In FIG. 6A, the upper retractable sign (610) is shown in a display position (600), and in FIG. 6B, the upper retractable sign (610) is shown in a retracted position (620). Referring to FIG. 1, the upper retractable sign (610) may be disposed in the fixture (100) at an elevated level, e.g., in front of the top-most rod shelves. The upper retractable sign may be attached to and supported by one or more rod shelves, e.g., on front-facing engagement teeth as shown in FIG. 2. In the display position (600), the upper retractable sign may cover the rod shelves. Accordingly, in the display position (600), the upper retractable sign may be visible by a person facing the fixture (100), while one or more rod shelves behind the upper retractable sign may be covered (entirely or partially) by the upper retractable sign. When in the retracted position (620), the upper retractable sign allows access to the rod shelves that are covered by the upper retractable sign when in the display position. The upper retractable sign may be guided by tracks to transition from the display position (600) to the retracted position (620) and back to the display position (600). The upper retractable sign may be mechanically arrested in the retracted position above the rod shelves, e.g., by magnets. When in the retracted position (620), a user may add or remove goods to/from the rod shelves that would be covered by the upper retractable sign when in the display position (600).

Figure 6C:
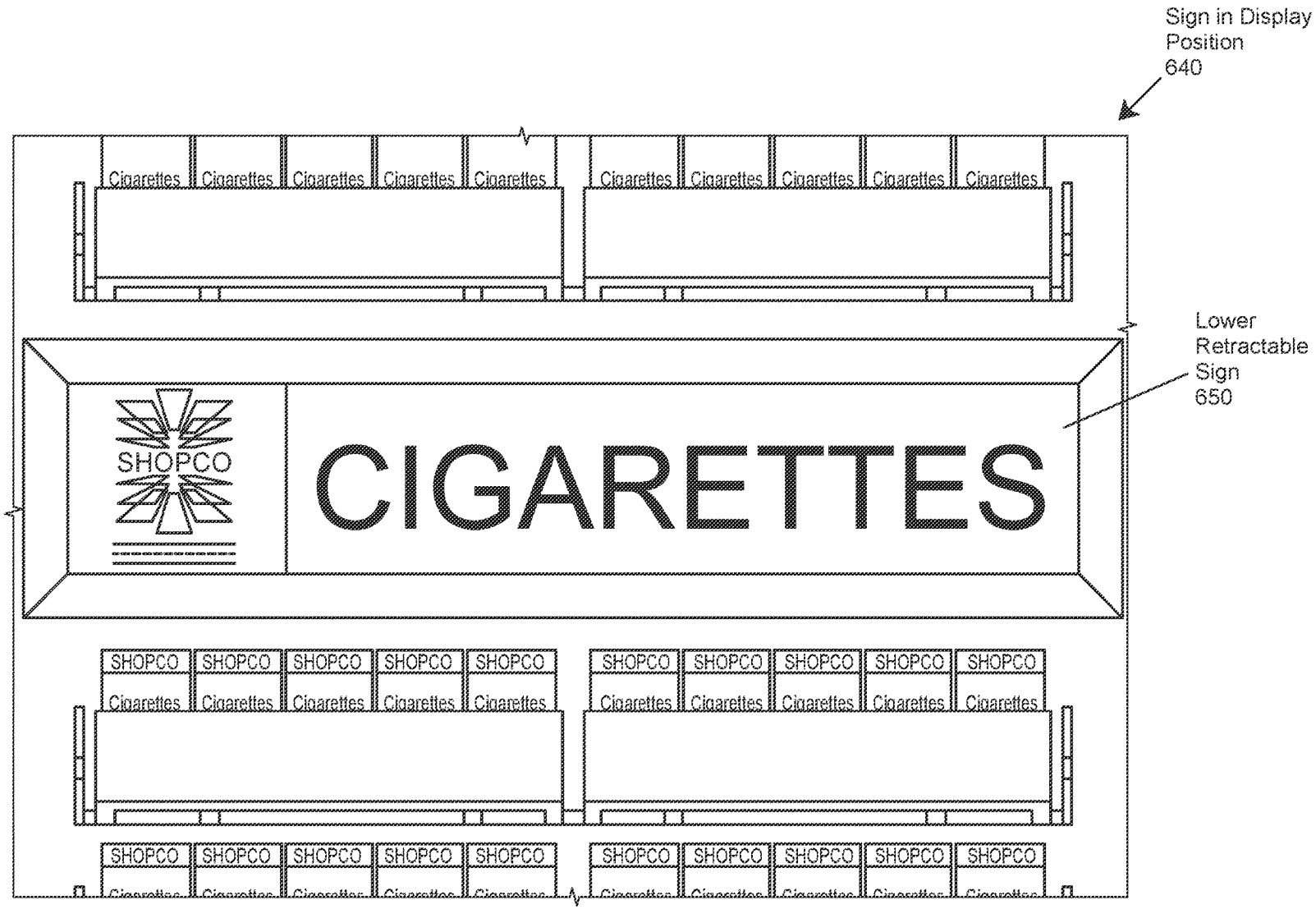
FIG. 6C shows a lower retractable sign in a display position, in accordance with one or more embodiments of the disclosure.
Figure 6D:
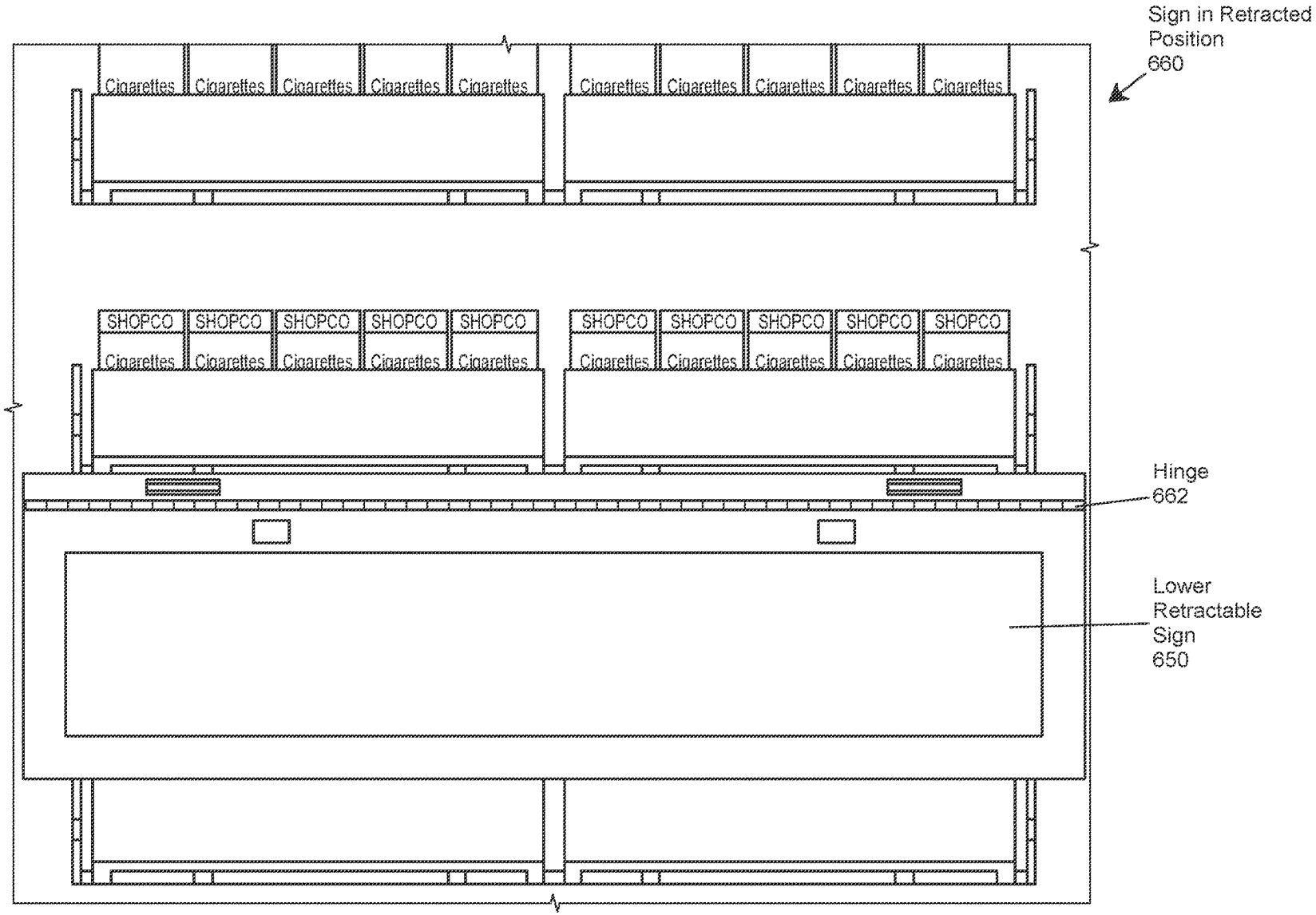
FIG. 6D shows a lower retractable sign in a retracted position, in accordance with one or more embodiments of the disclosure.

Turning to FIG. 6C and FIG. 6D, lower retractable signs, in accordance with one or more embodiments, are shown. In FIG. 6C, the lower retractable sign (650) is shown in a display position (640), and in FIG. 6D, the lower retractable sign (650) is shown in a retracted position (660). Referring to FIG. 1, the lower retractable sign (610) may be disposed in the fixture (100) on an intermediate or lower level, e.g., similar to the retractable sign (140) in FIG. 1. The lower retractable sign may be attached to and supported by one or more rod shelves, e.g., on front-facing engagement teeth as shown in FIG. 2. In the display position (640), the lower retractable sign may cover (entirely or partially) the one or more rod shelves. Accordingly, in the display position (640), the sign may be visible by a person facing the fixture (100), while one or more rod shelves behind the lower retractable sign may be covered by the lower retractable sign. When in the retracted position (660), the lower retractable sign allows access to the rod shelves that are covered by the lower retractable sign when in the display position. When in the display position (640), the lower retractable sign (650) may be held in place using one or more magnets (or another adhering material). The lower retractable sign may be installed using a hinge (662). The hinge (662) may enable a downward pivoting of the lower retractable sign from the display position (640) to the retracted position (660) and back to the display position (640). When in the retracted position (660), a user may add or remove goods to/from the rod shelves that would be covered by the sign when in the display position (640). Because the lower retractable sign (650) is held in the display position (640) by one or more magnets (or another adhering material), no return springs driving the sign form the retracted position (660) back to the display position (640) are needed. The benefit of this configuration is that a user may not need to permanently counter the force of the return springs, when loading the area behind the lower retractable sign (650) with goods, enabling a more efficient loading using both hands. In addition, unlike springs that tend to wear out over time, magnets (or another adhering material) provide a continuous performance.

In one or more embodiments, the upper retractable sign (610) and/or the lower retractable sign (650) are illuminated. For example, LED lighting may be integrated in the upper retractable sign (610) and/or the lower retractable sign (650).

Figure 7B:
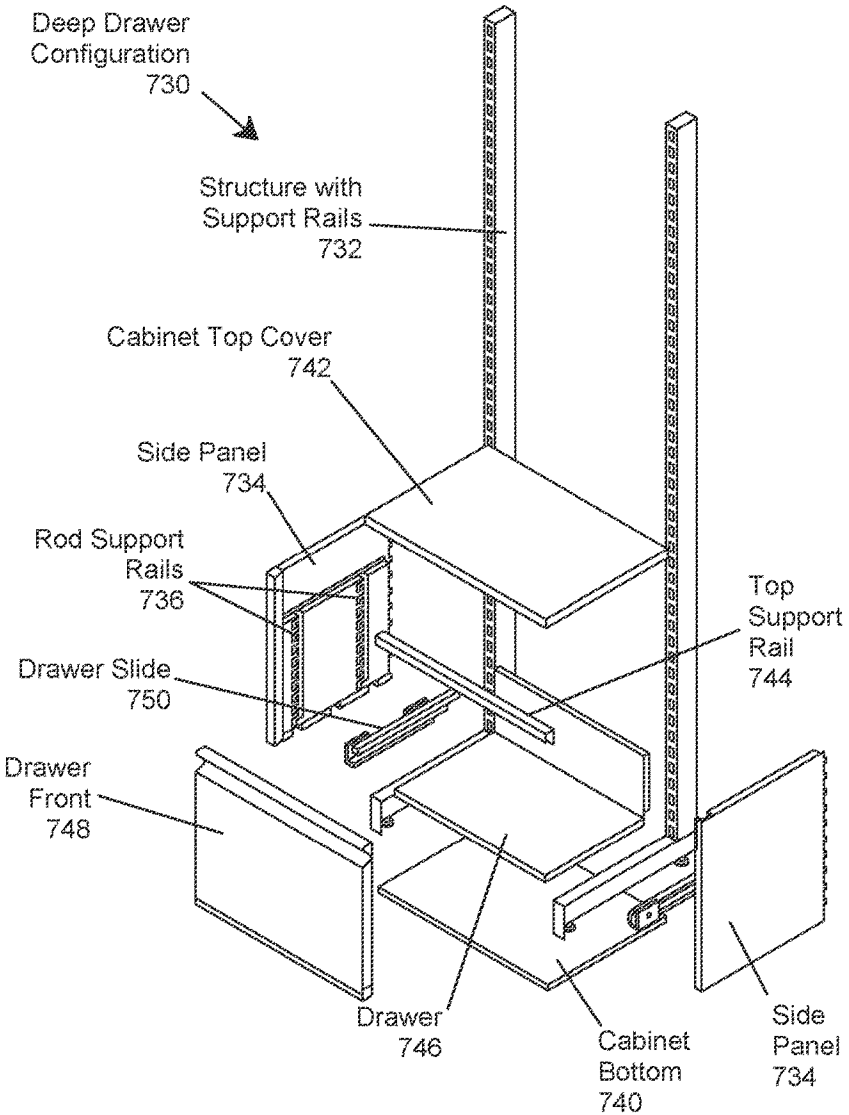
FIG. 7B shows a deep drawer configuration of the fixture, in accordance with one or more embodiments of the disclosure.
Figure 7A:
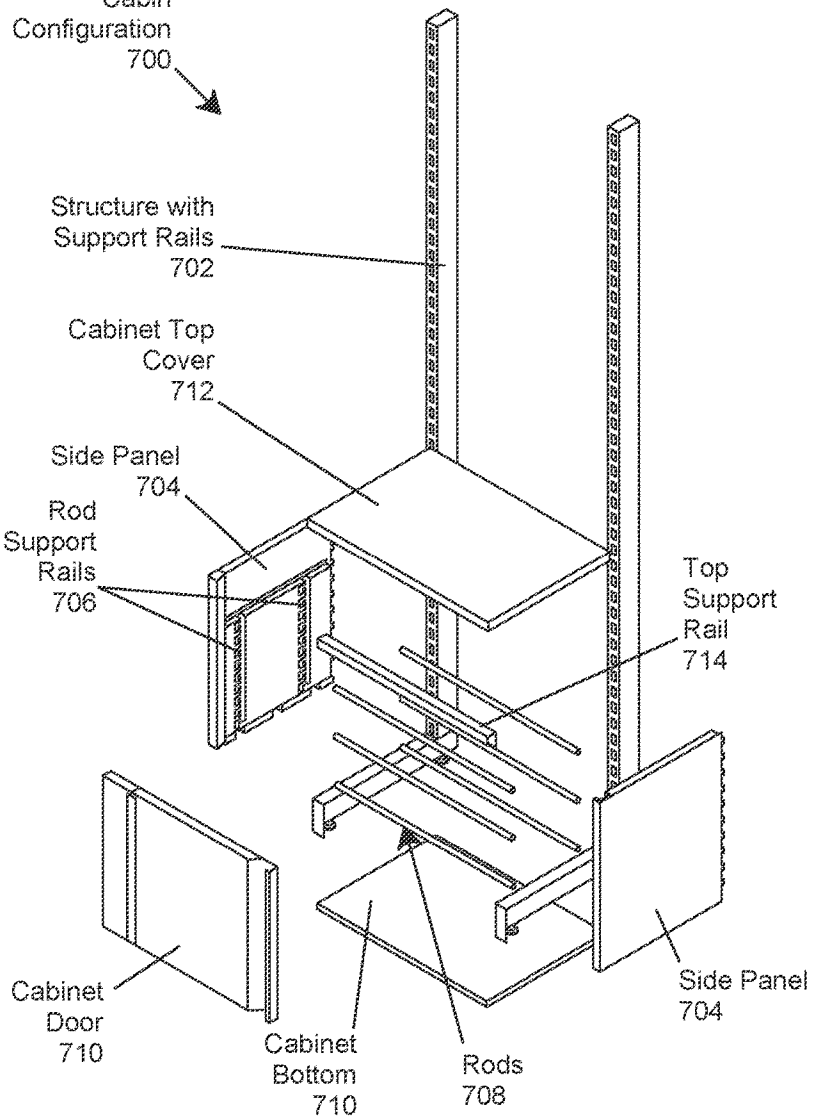
FIG. 7A shows a cabinet configuration of the fixture, in accordance with one or more embodiments of the disclosure.
Figure 7C:
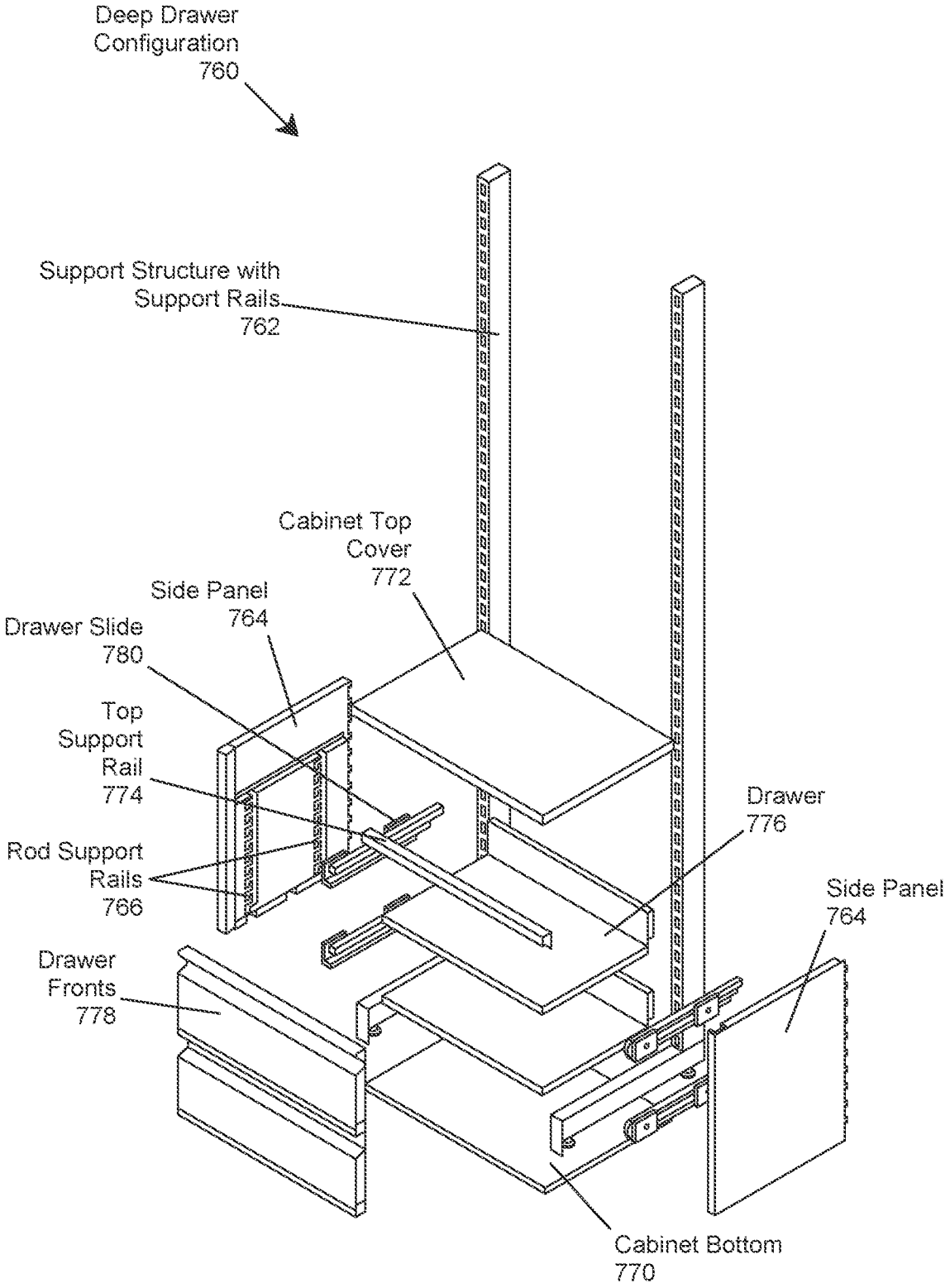
FIG. 7C shows a double drawer configuration of the fixture, in accordance with one or more embodiments of the disclosure.

Turning to FIGS. 7A, 7B, and 7C different configurations of cabinets and drawers are shown. As further discussed below, drawers and/or cabinets may be used to store additional goods, typically in a lower area of the fixture that is less visible.

In FIG. 7A, a cabinet configuration (700) is shown. Various components, forming a cabinet, are disposed on the support rails (702) of the support structure. The components may be removably hooked into the support structure, as previously described. In the example of FIG. 7A, cabinet side panels (704), a cabinet top cover (712), a cabinet bottom (710), and a cabinet door (710) are installed. A top support rail (714) provides additional support between the side panels (704). In one or more embodiments, the side panels (704) include rod support rails (706). Rods (708) may be inserted into the rod support rails (706) at the desired level. The rods (708) may support configurable or standard tray assemblies as previously described. Tray assemblies used in cabinets may be slightly narrower than tray assemblies used on rod shelves, though, in order to adjust for the potentially reduced available space in the cabinet.

In FIG. 7B, a deep drawer configuration (730) is shown. Various components, forming a drawer cabinet, are disposed on the support rails (762) of the support structure. The components may be removably hooked into the support structure, as previously described. In the example of FIG. 7B, cabinet side panels (734), a cabinet top cover (742), and a cabinet bottom (740) are installed. A top support rail (744) provides additional support between the side panels (734). In one or more embodiments, the side panels (734) include rod support rails (736). Drawer slides (750) may be installed on the rod support rails (736) at the desired level. The drawer slides (750) are for a drawer (746). The drawer (746) includes a drawer front (748).

In FIG. 7C, a double drawer configuration (760) is shown. Various components, forming a drawer cabinet, are disposed on the support rails (732) of the support structure. The components may be removably hooked into the support structure, as previously described. In the example of FIG. 7C, cabinet side panels (764), a cabinet top cover (772), and a cabinet bottom (770) are installed. A top support rail (774) provides additional support between the side panels (764). In one or more embodiments, the side panels (764) include rod support rails (766). Drawer slides (780) may be installed on the rod support rails (766) at the desired level. Two sets of drawer slides for two drawers may be installed. The drawer slides (750) are for the drawers (776). The drawers (776) include drawer fronts (778).

While FIG. 1, FIG. 2, FIG. 3, FIG. 4A, FIG. 4B, FIG. 5A, FIG. 5B, FIG. 5C, 5D, FIG. 6A, FIG. 6B, FIG. 6C, FIG. 6D, FIG. 7A, FIG. 7B, and FIG. 7C show configurations of components, other configurations may be used without departing from the scope of the disclosure. For example, various components may have geometries deviating from the geometries as shown, may be made from materials that are different from those described, may be assembled using installation materials and/or methods different from those described, etc. Accordingly, for at least the above-recited reasons, embodiments of the disclosure should not be considered limited to the specific arrangements of components and/or elements shown in FIG. 1, FIG. 2, FIG. 3, FIG. 4A, FIG. 4B, FIG. 5A, FIG. 5B, FIG. 5C, FIG. 5D, FIG. 6A, FIG. 6B, FIG. 6C, FIG. 6D, FIG. 7A, FIG. 7B, and FIG. 7C.

Figure 8:
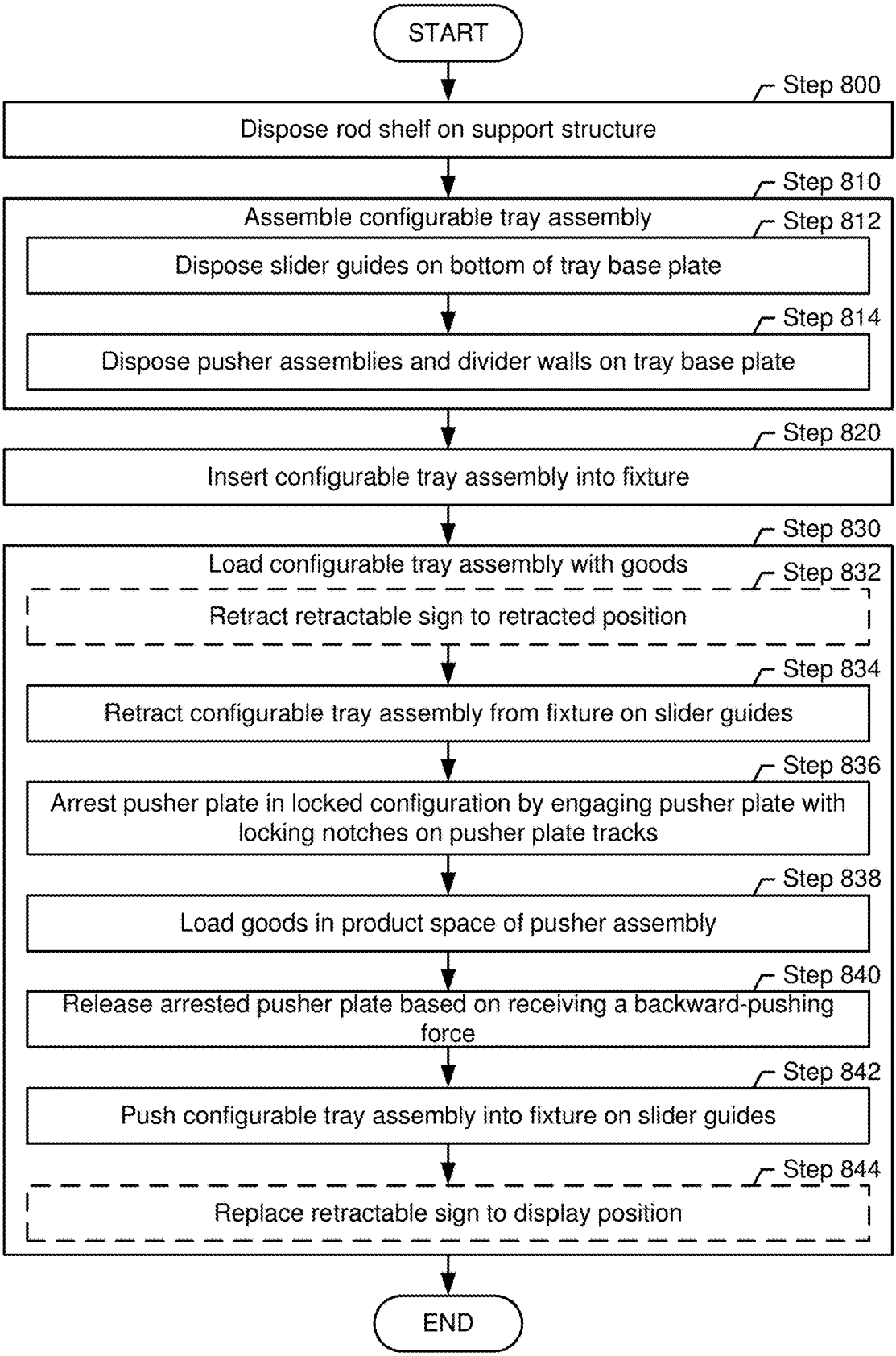
FIG. 8 shows a flowchart, in accordance with one or more embodiments of the disclosure.

FIG. 8 shows a flowchart in accordance with one or more embodiments of the disclosure. While the various steps in these flowcharts are presented and described sequentially, one of ordinary skill will appreciate that some or all of these steps may be executed in different orders, may be combined or omitted, and some or all of the steps may be executed in parallel. In one embodiment of the disclosure, the steps shown in FIG. 8 may be performed in parallel with any other steps shown in FIG. 8, without departing from the disclosure.

Turning to FIG. 8, a method for storage and presentation of goods, in accordance with one or more embodiments of the disclosure, is shown.

In Step 800, a rod shelf is disposed on a support structure of the fixture for storage and presentation of goods. The rod shelf may be disposed anywhere, e.g., at any level, depending on the goods to be held. Step 800 may be repeated until all rod shelves are disposed on the support structure, as desired.

In Step 810, a configurable tray assembly is assembled. Assembling a configurable tray assembly may involve multiple steps, e.g., Steps 812 and 814, and may be repeated for all configurable tray assemblies to be accommodated by the fixture.

In Step 812, slider guides are disposed on the bottom of the tray base plate. Disposing the slider guides may involve engaging the slider guides with corresponding slider guide clips of the tray base plate. A tray base plate with slider guides is shown in FIG. 4A.

In Step 814, pusher assemblies are disposed on the tray base plate. A pusher assembly may be disposed on the top surface of the tray base plate by engaging edge clips of the pusher assembly with raised edges of the tray base plate. A tray base plate with three pusher assemblies installed is shown in FIG. 3. Any number of pusher assemblies may be installed. Divider walls may be installed in a similar manner.

In Step 820, the configurable tray assembly is inserted into the fixture. Inserting the configurable tray assembly into the fixture may involve clipping the slider guides of the configurable tray assembly to the rods of the rod shelf on which the configurable tray assembly is to be placed. The insertion may involve two insertion movements, as discussed with reference to FIG. 4B. First, the configurable tray assembly is moved backwards and downwards into the fixture, based on the rear rod claws of the slider guides having a downward angle. For a user, this movement may be easier and/or more intuitive to perform than a straight backward movement. Once the rear rod claws have engaged with the rod on the rear of the rod shelf, a second insertion movement may be performed to engage the front rod claws of the slider guides with the rod at the front of the rod shelf. The front rod claws are straight downward oriented, and accordingly a simple downward movement of the front of the configurable tray assembly may be sufficient to engage the front rod claws with the rod. Step 820 may be repeated for any number of configurable tray assemblies to be installed in the fixture.

In Step 830, a configurable tray assembly is loaded with goods. Loading the tray assembly may involves multiple steps, e.g., Steps 832-844, and may be repeated for all configurable tray assemblies to be accommodated by the fixture.

In Step 832, the retractable sign preventing access (entirely or partially) to the configurable tray assembly is retracted. The retraction of the retractable sign from a display position to a retracted position is described with reference to FIGS. 6A and 6B for an upper retractable sign, and with reference to FIGS. 6C and 6D for a lower retractable sign. The execution of Step 832 is optional and may not be necessary if no retractable sign prevents access to the configurable tray assembly.

In Step 834, the configurable tray assembly may be retracted from the fixture. The retraction may be drawer-like, with the slider guides being clipped to the rods of the rod shelf remaining stationary, and the configurable tray assembly sliding along the slider guides. Accessibility of a product space of the pusher assemblies to be loaded with goods may be facilitated by the retraction from the fixture. Step 834 may be performed for any of the configurable tray assemblies to be loaded with goods.

The following Steps 836-840 may be performed for each of the pusher assemblies on the configurable tray assembly to be loaded with goods.

In Step 836, the pusher plate of the pusher assembly to be loaded with goods is arrested in a locked configuration. In the locked configuration a distance between the pusher plate and the front plate of the pusher assembly may be large to obtain a large product space for loading the pusher assembly with goods. The product space may be maximized by arresting the pusher plate in a position substantially as distant as possible from the front plate. To arrest the pusher plate, the pusher plate is engaged with locking notches in the pusher plate tracks of the pusher assembly, as described with reference to FIG. 5B and FIG. 5C. The engaging of the pusher plate may be accomplished by a slight forward pivoting of the pusher plate.

In Step 838, goods are loaded in the product space of the pusher assembly. With the pusher plate being arrested, a user may load goods using both hands for a simpler and more efficient loading.

In Step 840, the arrested pusher plate is released. The release may be triggered based on the pusher plate receiving a backward pushing force that pivots the pusher plate in a fully upright position, thereby causing the pusher plate to exit the locking notches in the pusher plate tracks. Additional details are visible in FIG. 5B and FIG. 5C. As a result of the release of the pusher plate, the pusher plate may freely move on the pusher plate tracks and may push the goods in the product space forward, toward the front plate.

In Step 842, the configurable tray assembly may be pushed back into the fixture to return the configurable tray assembly to the state prior to the retraction performed in Step 834.

In Step 844, the retractable sign is replaced to the display position. The execution of Step 844 is optional and may only be performed if Step 832 was performed.

Embodiments of the disclosure have one or more of the following benefits or advantages. Although the advantages or benefits are described based on a fixture being used for tobacco products, at least some of the benefits or advantages may also materialize when the fixture is used for non-tobacco products.

Tobacco companies frequently only contract with a store, on a fixture that is behind the sales counter, and is clearly visible and marketable to the consumer standing in front of the sales counter. Clearly visible is defined as product that can be viewable from a certain point from the top and bottom of the fixture, or what is known in the industry as the "vision box"

The vision box does not necessarily have a height restriction (how high a tobacco company will contract), but it may have a restriction on how low the tobacco company will contract. A common height requirement, used for years, is 24 inches. A tobacco company may, thus, not contract on fixture space 24 inches or lower, above the floor. However, the tobacco company may contract on all space above the 24 inch line. One or more embodiments of the disclosure thus offer cabinets or drawers that may be 24" tall, to make use of otherwise non-productive space.

Tobacco companies may pay the store based on the amount of facings (pushers) or the percent of square inches they encompass on the fixture. Tobacco companies may only contract with a store location if they agree to visibly market the products of their choice (the products they are trying to push). In a common scenario, 80% of tobacco product sales come from only 20% of the brands, which leaves 80% of the slower salable brands with no viable storage space. Store owners may, nevertheless, need these brands to satisfy consumer requests, but without using the valuable space in the vision box. In one or more embodiments, such products may be placed in cabinets or drawers, and/or behind retractable signs. If no such constraint exists, fixtures with no cabinets may be used, to extend the vision box to the bottom of the fixture.

Turning to the cabinets, embodiments of the disclosure offer a variety of cabinet choices to meet the needs of a store owner/operator and the tobacco companies, including cabinets with doors, single deep drawers, and double deep drawers. A locking option may be added, which is beneficial for tobacco products that tend to be expensive. Store owners frequently appreciate the option of having the ability to store their excessive inventory in a lockable cabinet.

Due to the unique design of the cabinets using slotted side walls and rods, additional product storage/overflow may be available. In one example, the cabinet configuration may house a maximum of three rows of additional single pack product storage, and a maximum of eight facings (or eight pusher assemblies) per row, utilizing two to four column self-contained/fixed trays. Additional space is thus available for product overflow or to house brands that the tobacco companies do not permit within the visible space.

Due to the unique design of the deep drawers using slotted side walls and rods, additional product storage/overflow may be available. The configuration may house a maximum of one row of additional single pack product storage, and a maximum of nine facings (or nine pushers) per row, utilizing one to four column self-contained/fixed trays and one to five column self-contained trays. Additional space is thus available for product overflow or to house brands that the tobacco companies do not permit within the visible space.

Turning to the retractable signs, in one or more embodiments, the retractable signs on the fixture are designed for easy usability. For example, a snap-frame may be used for easier access to add or replace the transparent product graphics.

The upper retractable sign not only lifts to expose additional space for product storage or overflow, it also retracts and slides backwards. Accordingly, when the operator is filling the product into the pusher assemblies (behind the retractable sign), there is no need to hold the retractable sign up with one hand while filling product into the pusher assemblies with the other hand. This may increase speed and productivity of the fill or refill.

Unlike in competing products, the lower retractable sign is held in place in the display position by strong earth magnets (vs commonly used spring load action). The lower retractable sign flips downward to expose additional space for product storage or overflow. Accordingly, when the operator is filling the product into the pusher assemblies (behind the retractable sign), it is not necessary to hold the retractable sign down with one hand while filling product into the pusher with the other hand. This may increase speed and productivity of the fill or refill.

Turning to the pusher assemblies, individual pusher assemblies are highly configurable and may accommodate various product shapes, including round (cylindrical) products, which is typical for moist snuff, etc. The width may be adjusted as needed. When utilizing pushers for round moist snuff cans, a configurable tray may hold a maximum of eight pushers (with all nine dividers in place).

Standard pushers are designed to reflect merchandising potential of cigarette or cigar packs, but may also be utilized for any other product. Standard pushers are designed for flexibility to adjust widths as needed. This may be beneficial when merchandising cigarettes that are called "Wides" or "25's". While typical cigarette packs come with 20 cigarettes, Wides may come with 20 cigarettes, however the circumference of each stick is larger, hence the packs are wider to handle this product. The "25's" have the same pack width as the "Wides", however the same Circumference as a traditional stick, but they are marketed with 25 sticks per pack. These type products may not fit in a 10-column fixed tray. However, standard pushers in a configurable layout may accommodate these products. When utilizing pushers for traditional cigarette packs, a configurable tray may hold a maximum of nine pushers (with all ten dividers in place) or a maximum of eight pushers (with all nine dividers in place), when merchandising "Wides" or "25's".

Small vapor pushers are designed to reflect the smaller product size. While designed for vaping products, small vapor pushers may also be utilized for other products. The width may be adjusted as needed. When utilizing pushers for small vapor or CBD products, a configurable tray may hold a maximum of thirteen pushers (with all fourteen dividers in place).

The ten-column fixed tray, in accordance with one or more embodiments, provides standard facings or pushers for a standard 24 inch fixture, which traditionally provides only nine standard facings or pushers. By eliminating gaps, valuable space is made available for the installation of the additional standard facing or pusher. By utilizing the ten-column tray instead of the traditional nine-column tray, fourteen additional pack facings or pushers may be added to an eight foot standard sized fixture for cigarettes. This creates more storage space and increases contract opportunities for the store. For example, four instead of three companies may be contracted, thus having a positive operational and financial impact.

All pusher assemblies may be particularly user friendly and efficient because the pusher plate slides all the way to the rear and when slightly tilted forward, locks into place. The operator may, thus, utilize both hands when loading product, instead of holding a product carton in one hand and push-loading one to two product(s) at a time. Once loaded, a gentle push releases the pusher plate to push the product in a forward direction.

Turning to the support structure, the frame or support structure of the fixture may be entirely metal (steel). Competitors' fixtures are frequently using wood or aluminum materials instead. Accordingly, the fixture as described is considerably sturdier than other fixtures. Further, fixtures in accordance with one or more embodiments are modular, with interchangeable parts, thus making the fixtures versatile. By avoiding welded joints, a fixture may be quickly and easily assembled, disassembled and reconfigured.

While the disclosed technology has been described with respect to a limited number of embodiments, those skilled in the art, having benefit of this disclosed technology, will appreciate that other embodiments can be devised which do not depart from the scope of the disclosed technology as disclosed herein. Accordingly, the scope of the disclosed technology should be limited only by the attached claims.

What is claimed is:

1. A configurable tray assembly to be disposed in a fixture for storage and presentation of goods, the configurable tray assembly comprising:

a tray base plate with a bottom surface configured to be disposed onto a rod shelf of the fixture, wherein the tray base plate comprises raised edges;

a pusher assembly disposed on a top surface of the tray base plate, the pusher assembly comprising:

a pusher base structure;

a pusher plate track connected to the pusher base structure, opposite the tray base plate;

a front plate extending from the pusher base structure, away from the tray base plate, wherein the front plate is stationary with respect to the pusher base structure; and a corresponding movable pusher plate slidably connected to the pusher plate track and extending from the pusher base structure, away from the tray base plate, wherein the corresponding movable pusher plate is further configured to push the goods toward the front plate by sliding along the pusher plate track, wherein the pusher assembly is further configured to hold the goods on the pusher base structure and between the front plate and the corresponding movable pusher plate;

divider walls connected to the tray base plate adjacent the pusher base structure, wherein the divider walls are further disposed to laterally enclose the pusher assembly and to laterally guide the goods in the pusher assembly;

edge clips extending from the divider walls, wherein the edge clips are configured to engage with the raised edges of the tray base plate to removably attach the divider walls to the tray base plate and to permit lateral adjustment of the divider walls; and a plurality of slider guides configured to removably attach the configurable tray assembly to rods of the rod shelf, and wherein the plurality of slider guides each permit the tray base plate to slide with respect to the rods of the rod shelf, wherein each of the plurality of slider guides comprises:

rear rod claws configured to engage with a rearward rod of the rod shelf, the rearward rod located rearward with respect to the fixture, wherein the rear rod claws are tilted towards the rearward rod; and front rod claws configured to engage with a front rod of the rod shelf, the front rod located forward with respect to the fixture, wherein the front rod claws are oriented directly toward the front rod.

2. The configurable tray assembly of claim 1, wherein the pusher assembly further comprises:

a spiral spring configured to exert a spring force on the corresponding movable pusher plate, in a direction along the pusher plate track and toward the front plate.

3. The configurable tray assembly of claim 2, wherein the pusher plate track comprise a locking notch configured to engage with the corresponding movable pusher plate.

4. The configurable tray assembly of claim 3, wherein a pivoting of the corresponding movable pusher plate enables the corresponding movable pusher plate to engage with the locking notch to prevent movement of the corresponding movable pusher plate, and wherein a manual force opposing the spring force reverses the pivoting to enable passing of the locking notch by the corresponding movable pusher plate.

5. The configurable tray assembly of claim 1, further comprising:

a plurality of support rails connected to the tray base plate.

6. The configurable tray assembly of claim 5, further comprising:

engagement teeth extending from at least some of the plurality of support rails.

7. The configurable tray assembly of claim 1, further comprising:

a retractable sign connected to the tray base plate.

8. The configurable tray assembly of claim 7, wherein the retractable sign is connected to the tray base plate via at least one hinge.

9. The configurable tray assembly of claim 7, wherein the retractable sign is slidably disposed with respect to tray base plate.

10. The configurable tray assembly of claim 1, further comprising:

a support rail connected to the tray base plate.

11. The configurable tray assembly of claim 10, further comprising:

a drawer slide connected to the support rail.

12. The configurable tray assembly of claim 11, further comprising:

a side panel connected to the drawer slide.

13. The configurable tray assembly of claim 1, further comprising:

a drawer front connected to the tray base plate.

14. The configurable tray assembly of claim 1, further comprising:

a support structure connected to the tray base plate.

* * * * *